US009780455B2

(12) United States Patent
Miyake

(10) Patent No.: US 9,780,455 B2
(45) Date of Patent: Oct. 3, 2017

(54) ANTENNA DEVICE AND COMMUNICATION EQUIPMENT

(71) Applicant: Funai Electric Co., Ltd., Daito-shi, Osaka (JP)

(72) Inventor: Yasunari Miyake, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 282 days.

(21) Appl. No.: 14/370,667

(22) PCT Filed: Dec. 10, 2012

(86) PCT No.: PCT/JP2012/081920
§ 371 (c)(1),
(2) Date: Jul. 3, 2014

(87) PCT Pub. No.: WO2013/103067
PCT Pub. Date: Jul. 11, 2013

(65) Prior Publication Data

US 2014/0375508 A1 Dec. 25, 2014

(30) Foreign Application Priority Data

Jan. 5, 2012 (JP) ..... 2012-000525

(51) Int. Cl.
*H01Q 5/00* (2015.01)
*H01Q 9/42* (2006.01)
(Continued)

(52) U.S. Cl.
CPC ..... *H01Q 9/045* (2013.01); *H01Q 1/243* (2013.01); *H01Q 1/38* (2013.01); *H01Q 5/378* (2015.01);
(Continued)

(58) Field of Classification Search
CPC .. H01Q 5/20; H01Q 5/25; H01Q 5/30; H01Q 5/378; H01Q 5/392; H01Q 5/50;
(Continued)

(56) References Cited

U.S. PATENT DOCUMENTS 6,028,567 A 2/2000 Lahti
6,639,560 B1 * 10/2003 Kadambi ..... H01Q 1/243 343/700 MS
(Continued)

FOREIGN PATENT DOCUMENTS

EP 1 122 812 A2 8/2001
EP 2 141 766 A1 1/2010
(Continued)

OTHER PUBLICATIONS

International Search Report (PCT/ISA/210) dated Mar. 12, 2013, with English translation (Five (5) pages).
(Continued)

*Primary Examiner* — Tho G Phan
*Assistant Examiner* — Patrick Holecek
(74) *Attorney, Agent, or Firm* — Crowell & Moring LLP

(57) ABSTRACT

An antenna device (10) includes a feed element (11) including a first portion (111) and a second portion (112) and a non-feed element (12) including a plurality of folded back portions (121 to 125). The width (W2) of the second portion of the feed element is rendered larger than the width (W3) of the non-feed element, and at least the second portion of the feed element is configured to be coupled to the plurality of folded back portions of the non-feed element.

15 Claims, 11 Drawing Sheets

(51) Int. Cl.

| | |
|---|---|
| ***H01Q 9/04*** | (2006.01) |
| ***H01Q 1/24*** | (2006.01) |
| ***H01Q 5/378*** | (2015.01) |
| ***H01Q 1/38*** | (2006.01) |
| ***H01Q 9/28*** | (2006.01) |
| ***H01Q 9/40*** | (2006.01) |

(52) U.S. Cl.
CPC ..... *H01Q 9/0414* (2013.01); *H01Q 9/28* (2013.01); *H01Q 9/40* (2013.01); *H01Q 9/42* (2013.01)

(58) Field of Classification Search
CPC ..... H01Q 9/04; H01Q 9/0414; H01Q 9/045; H01Q 9/0457; H01Q 9/30; H01Q 9/42; H01Q 1/22–1/245
See application file for complete search history.

(56) References Cited

U.S. PATENT DOCUMENTS

| | | | | |
|---|---|---|---|---|
| 7,315,289 | B2 | 1/2008 | Puente Baliarda et al. | |
| 7,956,812 | B2 * | 6/2011 | Chen ..... | H01Q 1/38 343/700 MS |
| 8,063,827 | B2 | 11/2011 | Hotta et al. | |
| 2006/0214856 | A1 | 9/2006 | Nakano et al. | |
| 2008/0129630 | A1 | 6/2008 | Baliarda et al. | |
| 2009/0221243 | A1 | 9/2009 | Egawa et al. | |
| 2010/0001908 | A1 * | 1/2010 | Chen ..... | H01Q 1/2266 343/700 MS |
| 2010/0103069 | A1 | 4/2010 | Wang et al. | |
| 2012/0032864 | A1 | 2/2012 | Hotta et al. | |

FOREIGN PATENT DOCUMENTS

| | | | |
|---|---|---|---|
| JP | 5-347507 | A | 12/1993 |
| JP | 2002-330023 | A | 11/2002 |
| JP | 2005-538623 | A | 12/2005 |
| JP | 2007-82037 | A | 3/2007 |
| JP | 2009-182608 | A | 8/2009 |
| WO | WO 2006/090673 | A1 | 8/2006 |

OTHER PUBLICATIONS

Japanese language Written Opinion (PCT/ISA/237) dated Mar. 12, 2013 (Three (3) pages).

* cited by examiner

FIRST EMBODIMENT

FOURTH EMBODIMENT

ANTENNA DEVICE AND COMMUNICATION EQUIPMENT

TECHNICAL FIELD

The present invention relates to an antenna device and a communication equipment, and more particularly, it relates to an antenna device and a communication equipment each including a feed element and a non-feed element.

BACKGROUND ART

In general, an antenna device including a feed element and a non-feed element is known. Such an antenna device is disclosed in National Patent Publication Gazette No. 2005-538623, for example.

In National Patent Publication Gazette No. 2005-538623, there is disclosed a multiband antenna (antenna device) including a first arm (feed element) supplied with power and a second arm (non-feed element) connected to a ground-plane. Furthermore, in the aforementioned patent document 1, there is described that a part of the first arm and a part of the second arm are coupled to each other thereby obtaining a wide band and acquiring a multiband capability.

In general, the antenna device is installed in a communication equipment, and hence downsizing of the antenna device is required.

PRIOR ART

Patent Document

Patent Document 1: National Patent Publication Gazette No. 2005-538623

SUMMARY OF THE INVENTION

Problems to be Solved by the Invention

National Patent Publication Gazette No. 2005-538623 neither discloses nor suggests specific characteristics related to the obtainment of the wide band of the multiband antenna or the acquisition of the multiband capability of the multiband antenna, and the magnitude (width) of a supportable band is unclear. Generally, the wide band is considered as a band in which the ratio of the maximum frequency of a utilized frequency to the minimum frequency of the utilized frequency is about 1.2. Thus, there may be such a problem that the multiband antenna according to the aforementioned patent document 1 simply obtaining the wide band cannot cope with the frequency of an ultrawide band in which the ratio of the maximum frequency of the utilized frequency to the minimum frequency of the utilized frequency is at least about 1.5. Furthermore, downsizing of the antenna device is conventionally required, and hence it may be very difficult to downsize the antenna device while allowing the antenna device to cope with the frequency of the ultrawide band.

The present invention has been proposed in order to solve the aforementioned problems, and an object of the present invention is to provide an antenna device and a communication equipment each capable of coping with the frequency of an ultrawide band while being downsized.

Means for Solving the Problems

In order to attain the aforementioned object, as a result of deep studies, the inventor has found that the width of a second portion of a feed element is rendered larger than the width of a non-feed element in directions orthogonal to the extensional directions of a plurality of folded back portions, at least the second portion of the feed element is configured to be coupled to the plurality of folded back portions, and the non-feed element includes the plurality of folded back portions folded back at a plurality of positions, whereby an antenna device can cope with the frequency (at least about 2.3 GHz and not more than about 3.5 GHz, for example) of an ultrawide band while being downsized. Such an effect that the antenna device can cope with the frequency of the ultrawide band has already been confirmed by a simulation conducted by the inventor, described later.

In other words, an antenna device according to a first aspect of the present invention includes a feed element including a first portion and a second portion having a width larger than the width of the first portion and a non-feed element including a plurality of folded back portions folded back at a plurality of positions, while the width of the second portion of the feed element is rendered larger than the width of the non-feed element in directions orthogonal to the extensional directions of the plurality of folded back portions, and at least the second portion of the feed element is configured to be coupled to the plurality of folded back portions of the non-feed element. Coupling indicates a wide concept including both electrostatic coupling and magnetic field coupling.

In the aforementioned antenna device according to the first aspect, as hereinabove described, the width of the second portion of the feed element is rendered larger than the width of the non-feed element in the directions orthogonal to the extensional directions of the plurality of folded back portions, and at least the second portion of the feed element is configured to be coupled to the plurality of folded back portions of the non-feed element, whereby the antenna device can cope with the frequency (at least about 2.3 GHz and not more than about 3.5 GHz, for example) of an ultrawide band. Furthermore, the non-feed element includes the plurality of folded back portions folded back at the plurality of positions, whereby a length necessary for the non-feed element can be ensured due to the plurality of folded back portions, unlike the case where the non-feed element is configured to extend linearly. Thus, it is not necessary to widen an arrangement region of the non-feed element, and hence the antenna device can be downsized. Therefore, this antenna device can cope with the frequency of the ultrawide band while being downsized.

The aforementioned antenna device according to the first aspect preferably further includes a ground plane configured to ground the non-feed element, a first end of the non-feed element is preferably grounded to the ground plane, and a second end of the non-feed element is preferably open. According to this structure, the antenna device can easily cope with the frequency of the ultrawide band by coupling the non-feed element grounded to the ground plane to the second portion of the feed element.

In the aforementioned antenna device according to the first aspect, the feed element is preferably formed to extend linearly, and the length of the second portion along the extensional direction of the feed element is preferably substantially equal to the lengths of the plurality of folded back portions of the non-feed element along the extensional direction of the feed element. According to this structure, the second portion of the feed element can be effectively coupled to the plurality of folded back portions of the non-feed element, whereby the antenna device can easily cope with the frequency of the ultrawide band.

In this case, an upper end of the second portion of the feed element is preferably arranged at substantially the same height as an upper end of the folded back portions of the non-feed element in a plan view, and a lower end of the second portion of the feed element is preferably arranged at substantially the same height as a lower end of the folded back portions of the non-feed element in the plan view. According to this structure, the second portion of the feed element can be more effectively coupled to the plurality of folded back portions of the non-feed element. Furthermore, arrangement regions of the feed element and the non-feed element can be reduced in the height direction of the feed element and the non-feed element, and hence the antenna device can be effectively downsized.

In the aforementioned antenna device according to the first aspect, the feed element is preferably formed to extend linearly, and the plurality of folded back portions of the non-feed element are preferably formed to be folded back at the plurality of positions along the extensional direction of the feed element. According to this structure, the arrangement region of the non-feed element can be reduced in the linearly extensional direction of the feed element, and hence the antenna device can be further downsized.

In the aforementioned antenna device according to the first aspect, the feed element and the non-feed element are preferably formed on different layers. According to this structure, the feed element and the non-feed element can be easily arranged to be opposed to each other in a wider region, and hence the feed element and the non-feed element can be effectively coupled to each other.

In this case, the feed element and the non-feed element are preferably arranged to overlap with each other in a plan view. According to this structure, the plane areas of the arrangement regions of the feed element and the non-feed element can be reduced by the overlapping of the feed element and the non-feed element in the plan view, and hence the antenna device can be easily downsized.

In the aforementioned antenna device according to the first aspect, the feed element and the non-feed element are preferably formed on the same layer. According to this structure, the thickness of the entire device can be reduced.

In this case, the feed element and the non-feed element are preferably arranged to be separated by a distance allowing the feed element and the non-feed element to be coupled to each other. According to this structure, the feed element and the non-feed element are easily coupled to each other, and hence the antenna device can cope with the frequency of the ultrawide band.

The aforementioned antenna device according to the first aspect preferably further includes a ground plane configured to ground the non-feed element, the ground plane preferably has a corner formed by two sides substantially orthogonal to each other, and the first portion of the feed element and a first end of the non-feed element are preferably arranged in the vicinity of the corner of the ground plane. According to this structure, a side forming the corner of the ground plane to which the feed element and the non-feed element are grounded can function as an antenna.

In this case, the ground plane is preferably formed in a rectangular shape having the corner formed by the two sides substantially orthogonal to each other, and the first portion of the feed element and the first end of the non-feed element are preferably arranged in the vicinity of the corner of the ground plane having the rectangular shape. According to this structure, a side forming the corner of the ground plane in the rectangular shape to which the feed element and the non-feed element are grounded can function as an antenna.

In the aforementioned antenna device according to the first aspect, the first portion of the feed element is preferably configured to be coupled to the plurality of folded back portions of the non-feed element along with the second portion of the feed element. According to this structure, the antenna device coping with the ultrawide band can be more effectively configured by coupling both the second portion and the first portion of the feed element to the plurality of folded back portions of the non-feed element.

The aforementioned antenna device according to the first aspect preferably further includes a feeding point arranged on the side of the first portion of the feed element, supplying high-frequency power to the first portion of the feed element. According to this structure, the second portion of the feed element can be easily coupled to the non-feed element by supplying high-frequency power to the first portion of the feed element.

In the aforementioned antenna device according to the first aspect, the feed element is preferably formed to extend linearly, and the non-feed element is preferably arranged to be folded back at the plurality of positions such that the folded back portions extending along the extensional direction of the feed element are separated from each other. According to this structure, in the non-feed element including the plurality of folded back portions, the folded back portions extending along the extensional direction of the feed element can avoid interference with each other.

In the aforementioned antenna device according to the first aspect, the feed element is preferably formed to extend linearly, and the length of the first portion along the extensional direction of the feed element is preferably not more than one-half of the length of the second portion along the extensional direction of the feed element. According to this structure, the entire length of the feed element including the first portion and the second portion is reduced unlike the case where the length of the first portion is more than one-half of the length of the second portion, and hence the antenna device can be easily downsized.

A communication equipment according to a second aspect of the present invention includes an antenna device, and the antenna device includes a feed element including a first portion and a second portion having a width larger than the width of the first portion and a non-feed element including a plurality of folded back portions folded back at a plurality of positions, while the width of the second portion of the feed element is rendered larger than the width of the non-feed element in directions orthogonal to the extensional directions of the plurality of folded back portions, and at least the second portion of the feed element is configured to be coupled to the plurality of folded back portions of the non-feed element.

In the communication equipment according to the second aspect of the present invention, as hereinabove described, the width of the second portion of the feed element is rendered larger than the width of the non-feed element in the directions orthogonal to the extensional directions of the plurality of folded back portions, and at least the second portion of the feed element is configured to be coupled to the plurality of folded back portions of the non-feed element, whereby the communication equipment can cope with the frequency (at least about 2.3 GHz and not more than about 3.5 GHz, for example) of an ultrawide band. Furthermore, the non-feed element includes the plurality of folded back portions folded back at the plurality of positions, whereby a length necessary for the non-feed element can be ensured due to the plurality of folded back portions, unlike the case where the non-feed element is configured to extend linearly.

Thus, it is not necessary to widen an arrangement region of the non-feed element, and hence the antenna device can be downsized. Therefore, the communication equipment including this antenna device can be also downsized. The present invention is effective particularly for the communication equipment desiring downsizing such as a portable telephone.

In the aforementioned communication equipment according to the second aspect, the antenna device preferably further includes a ground plane configured to ground the non-feed element, a first end of the non-feed element is preferably grounded to the ground plane, and a second end of the non-feed element is preferably open. According to this structure, the communication equipment can easily cope with the frequency of the ultrawide band by coupling the non-feed element grounded to the ground plane to the second portion of the feed element.

In the aforementioned communication equipment according to the second aspect, the feed element is preferably formed to extend linearly, and the length of the second portion along the extensional direction of the feed element is preferably substantially equal to the lengths of the plurality of folded back portions of the non-feed element along the extensional direction of the feed element. According to this structure, the second portion of the feed element can be effectively coupled to the plurality of folded back portions of the non-feed element, whereby the communication equipment can easily cope with the frequency of the ultrawide band.

In this case, an upper end of the second portion of the feed element is preferably arranged at substantially the same height as an upper end of the folded back portions of the non-feed element in a plan view, and a lower end of the second portion of the feed element is preferably arranged at substantially the same height as a lower end of the folded back portions of the non-feed element in the plan view. According to this structure, the second portion of the feed element can be more effectively coupled to the plurality of folded back portions of the non-feed element. Furthermore, arrangement regions of the feed element and the non-feed element can be reduced in the height direction of the feed element and the non-feed element, and hence the antenna device can be effectively downsized. Thus, the communication equipment including the antenna device can be effectively downsized.

In the aforementioned communication equipment according to the second aspect, the feed element is preferably formed to extend linearly, and the plurality of folded back portions of the non-feed element are preferably formed to be folded back at the plurality of positions along the extensional direction of the feed element. According to this structure, the arrangement region of the non-feed element can be reduced in the linearly extensional direction of the feed element, and hence the antenna device can be further downsized. Thus, the communication equipment including the antenna device can be further downsized.

Effect of the Invention

According to the present invention, as hereinabove described, the antenna device can cope with the frequency (the frequency in the range of at least about 2.3 GHz and not more than about 3.5 GHz, for example) of the ultrawide band while being downsized.

MODES FOR CARRYING OUT THE INVENTION

Embodiments of the present invention are hereinafter described on the basis of the drawings.

First Embodiment

The structure of a portable telephone 100 according to a first embodiment of the present invention is now described with reference to FIGS. 1 to 4. The portable telephone 100 is an example of the "communication equipment" in the present invention.

Figure 1:
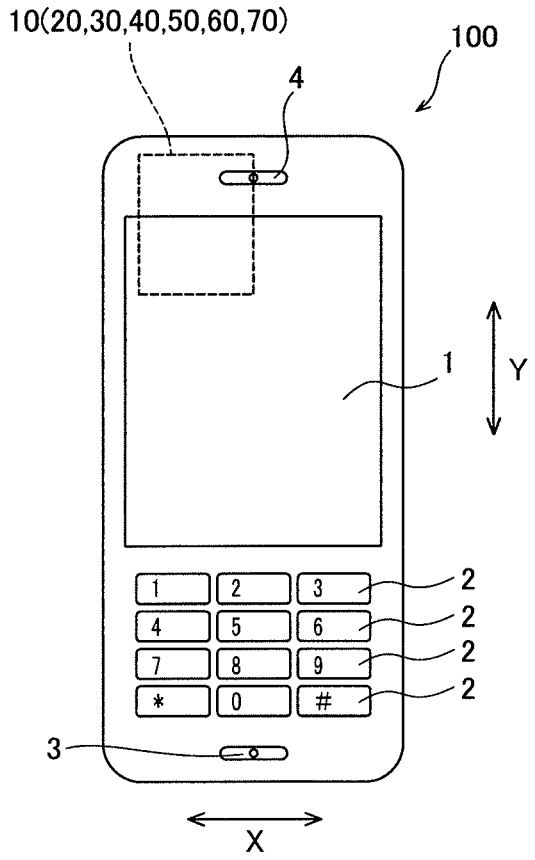
FIG. 1 A diagram showing the overall structure of a portable telephone according to a first embodiment of the present invention.

As shown in FIG. 1, the portable telephone 100 according to the first embodiment of the present invention has a substantially rectangular shape as viewed from the front side. The portable telephone 100 includes a display screen portion 1, operation portions 2 including number buttons etc., a microphone 3, and a speaker 4. Furthermore, an antenna device 10 is provided inside a housing of the portable telephone 100.

The antenna device 10 copes with an ultrawide band to be capable of coping with WiMAX (Worldwide Interoperability for Microwave Access) of a high-speed wireless communication network of a plurality of frequency bands (a 2.3 GHz band, a 2.6 GHz band, and a 3.5 GHz band).

Figure 2:
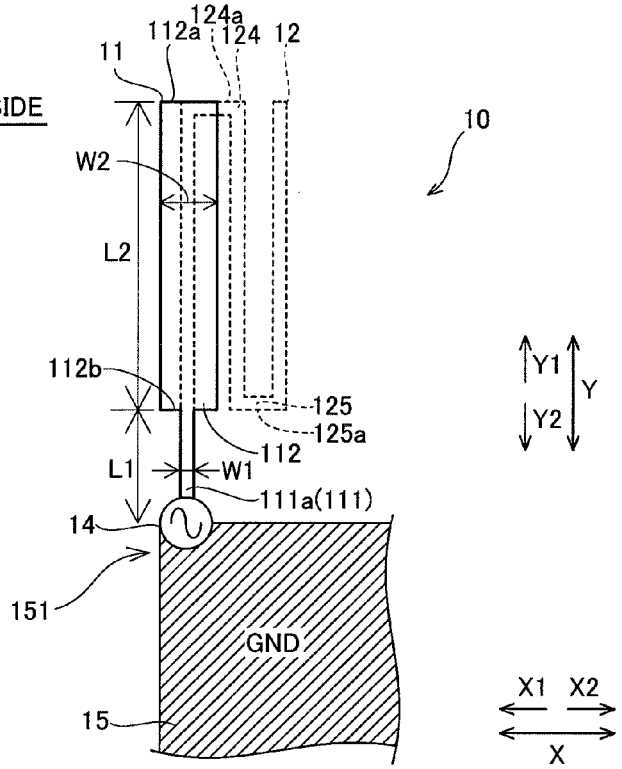
FIG. 2 A diagram showing an antenna device of the portable telephone according to the first embodiment of the present invention as viewed from the front surface side.
Figure 3:
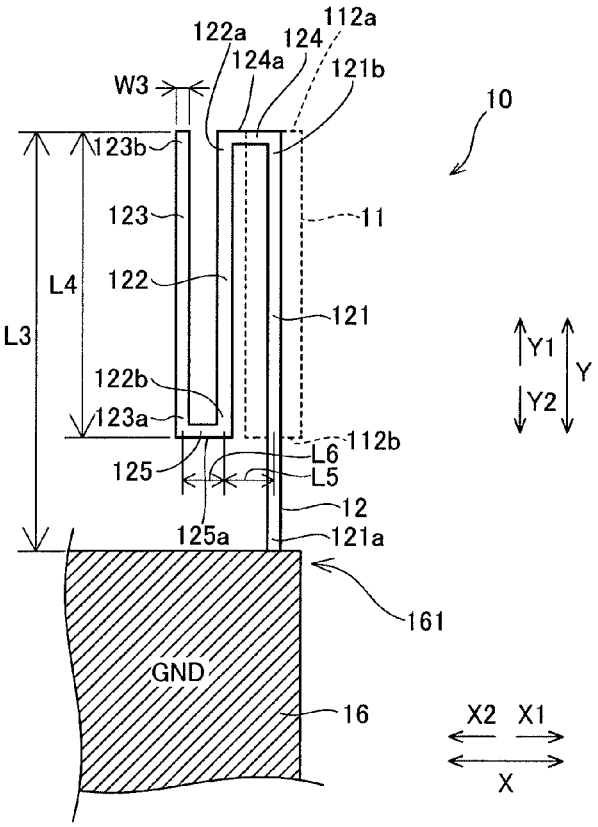
FIG. 3 A diagram showing the antenna device of the portable telephone according to the first embodiment of the present invention as viewed from the rear surface side.
Figure 4:
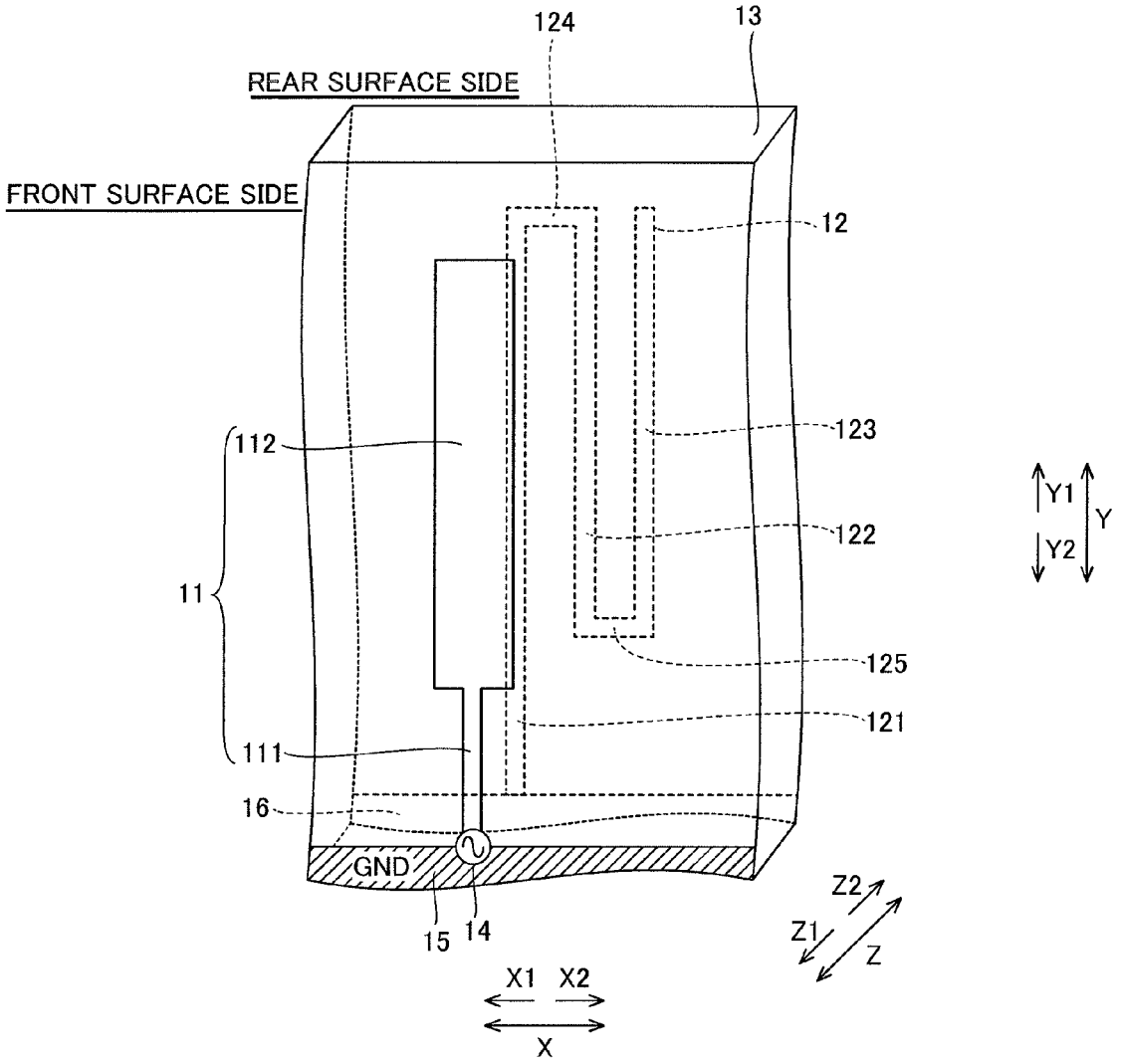
FIG. 4 A perspective view of the antenna device of the portable telephone according to the first embodiment of the present invention.

The antenna device 10 includes a feed element 11, a non-feed element 12, a substrate 13 on which the feed element 11 and the non-feed element 12 are arranged, a feeding point 14 supplying high-frequency power to the feed element 11, a first ground plane 15 (GND), and a second ground plane 16 (GND) to which the non-feed element 12 is grounded, as shown in FIGS. 2 to 4.

As shown in FIG. 4, the feed element 11 and the non-feed element 12 are formed on different surfaces (layers) of the substrate 13. Specifically, the feed element 11, the feeding point 14, and the first ground plane 15 are provided on the front surface (a surface on a Z1 side) of the substrate 13. The non-feed element 12 and the second ground plane 16 are provided on the rear surface (a surface on a Z2 side) of the substrate 13. The substrate 13 has a thickness of about 1 mm and is made of glass epoxy resin. The feed element 11 and the non-feed element 12 each are made of a conductor and have a thin plate shape.

As shown in FIGS. 2 and 4, the feed element 11 provided on the front surface (the surface on the Z1 side) of the substrate 13 is formed linearly to extend in a direction Y. The feed element 11 includes a first portion 111 located on a Y2 side and a second portion 112 located on a Y1 side. The first portion 111 and the second portion 112 each have a substantially rectangular shape in a plan view and are formed to extend in the direction Y. A lower end 111*a* of the first portion 111 of the feed element 11 is connected to the first ground plane 15 through the feeding point 14, and an upper end 112*a* of the second portion 112 is open.

The width W1 of the first portion 111 of the feed element 11 in a direction X (a direction orthogonal to the extensional direction of the feed element 11) is smaller than the width W2 of the second portion 112 of the feed element 11 in the direction X. The length L1 of the first portion 111 of the feed element 11 in the direction Y (a direction along the extensional direction of the feed element 11) is not more than one-half of the length of the feed element 11 in the direction Y. Specifically, the length L1 of the first portion 111 of the feed element 11 in the direction Y is about 3.2 mm, and the length L2 of the second portion 112 of the feed element 11 in the direction Y is larger than the length L1 of the first portion 111 and is about 8.8 mm. In other words, the length (L1+L2) from the lower end 111*a* of the first portion 111 of the feed element 11 to the upper end 112*a* of the second portion 112 of the feed element 11 is about 12.0 mm, and the ratio of the length L2 of the second portion 112 to the length L1 of the first portion 111 is about 2.75.

The second portion 112 of the feed element 11 is coupled to the entire non-feed element 12. The first portion 111 of the feed element 11 is coupled to the entire non-feed element 12 along with the second portion 112. The second portion 112 is coupled to the non-feed element 12 more strongly than the first portion 111. Coupling indicates a wide concept including both electrostatic coupling and magnetic field coupling.

As shown in FIGS. 3 and 4, the non-feed element 12 provided on the rear surface (the surface on the Z2 side) of the substrate 13 has a meander shape (zig-zag shape) bent at a plurality of positions on the whole. The non-feed element 12 includes a first straight portion 121, a second straight portion 122, and a third straight portion 123 formed to extend in the direction Y and a first coupling portion 124 and a second coupling portion 125 formed to extend in the direction X by folding back the first to third straight portions at two positions. The first straight portion 121, the second straight portion 122, and the third straight portion 123 extending in the direction Y of these first straight portion 121, second straight portion 122, third straight portion 123, first coupling portion 124, and second coupling portion 125 are arranged to be separated from each other. The first straight portion 121, the second straight portion 122, the third straight portion 123, the first coupling portion 124, and the second coupling portion 125 are examples of the "folded back portion" in the present invention.

According to the first embodiment, the first portion 111 and the second portion 112 of the feed element 11 are configured to be coupled to the entire non-feed element 12 (the first straight portion 121, the second straight portion 122, the third straight portion 123, the first coupling portion 124, and the second coupling portion 125).

A lower end 121*a* of the first straight portion 121 of the non-feed element 12 is grounded to the second ground plane 16. An upper end 121*b* of the first straight portion 121 and an upper end 122*a* of the second straight portion 122 of the non-feed element 12 are coupled by the first coupling portion 124 to be folded back. A lower end 122*b* of the second straight portion 122 and a lower end 123*a* of the third straight portion 123 of the non-feed element 12 are coupled by the second coupling portion 125 to be folded back. An upper end 123*b* of the third straight portion 123 of the non-feed element 12 is open.

As shown in FIGS. 2 and 3, the first portion 111 and the second portion 112 of the feed element 11 are arranged to overlap with the first straight portion 121 and a part on an X1 side of the first coupling portion 124 of the non-feed element 12 in a plan view. The upper end 112*a* of the second portion 112 of the feed element 11 is arranged at substantially the same height as an upper end 124*a* of the first coupling portion 124 of the non-feed element 12 in the plan view, and a lower end 112*b* of the second portion 112 of the feed element 11 is arranged at substantially the same height as a lower end 125*a* of the second coupling portion 125 of the non-feed element 12 in the plan view.

The length L3 (about 12.0 mm) of the first straight portion 121 in the direction Y is substantially equal to the length (L1+L2) (about 12.0 mm) of the first portion 111 and the second portion 112 of the feed element 11 in the direction Y. Furthermore, the length L3 (about 8.8 mm) of the second straight portion 122 and the third straight portion 123 of the non-feed element 12 in the direction Y is substantially equal to the length L2 (about 8.8 mm) of the second portion 112 of the feed element 11 in the direction Y.

The width W3 (about 0.4 mm) (see FIG. 3) of the non-feed element 12 in directions orthogonal to the extensional directions of the first straight portion 121, the second straight portion 122, the third straight portion 123, the first coupling portion 124, and the second coupling portion 125 is substantially the same (uniform) over a substantially entire portion (the substantially entire length) of the non-feed element 12. This width W3 (about 0.4 mm) of the non-feed element 12 in the directions orthogonal to the extensional directions of the first straight portion 121, the second straight portion 122, the third straight portion 123, the first coupling portion 124, and the second coupling portion 125 is substantially equal to the width W1 (about 0.4 mm) (see FIG. 2) of the first portion 111 of the feed element 11 in the direction X and is smaller than the width W2 (about 1.2 mm) (see FIG. 2) of the second portion 112 of the feed element 11 in the direction X.

The first straight portion 121, the second straight portion 122, and the third straight portion 123 are arranged parallel to each other, and the first coupling portion 124 and the second coupling portion 125 are arranged parallel to each other. The first straight portion 121 and the second straight portion 122 of the non-feed element 12 are arranged at an interval L5 (about 1.4 mm) (see FIG. 3), and the second straight portion 122 and the third straight portion 123 are arranged at an interval L6 (about 1.2 mm) (see FIG. 3).

As shown in FIG. 2, the first ground plane 15 arranged on the front surface of the substrate 13 is formed in a square shape having a side of about 40 mm. The first ground plane 15 has a corner 151 formed by two sides orthogonal to each other. The vicinity of the corner 151 of the first ground plane 15 is connected with the lower end 111*a* (the end on the Y2 side) of the first portion 111 of the feed element 11 through the feeding point 14.

As shown in FIG. 3, the second ground plane 16 arranged on the rear surface of the substrate 13 is formed in a square shape having a side of about 40 mm. The second ground plane 16 has a corner 161 formed by two sides orthogonal to each other. The vicinity of the corner 161 of the second ground plane 16 is connected with the lower end 121*a* (the end on the Y2 side) of the first straight portion 121 of the non-feed element 12.

According to the first embodiment, as hereinabove described, the width of the second portion 112 of the feed element 11 is rendered larger than the width of the non-feed element 12 in the direction orthogonal to the extensional direction of the two coupling portions 124 and 125, and at least the second portion 112 of the feed element 11 is configured to be coupled to the two coupling portions 124 and 125 of the non-feed element 12, whereby the antenna device 10 can cope with the frequency of the ultrawide band. Furthermore, the non-feed element 12 includes the two coupling portions 124 and 125 folded back at the two positions, whereby a length necessary for the non-feed element 12 can be ensured due to a plurality of folded back portions (the first straight portion 121, the second straight portion 122, the third straight portion 123, the first coupling portion 124, and the second coupling portion 125), unlike the case where the non-feed element 12 is configured to extend linearly. Thus, it is not necessary to widen an arrangement region of the non-feed element 12, and hence the antenna device 10 can be downsized. Therefore, this antenna device 10 can cope with the frequency (at least about 2.3 GHz and not more than about 3.5 GHz, for example) of the ultrawide band while being downsized.

According to the first embodiment, as hereinabove described, the lower end 121*a* of the first straight portion 121 of the non-feed element 12 is grounded to the ground plane 16, and the upper end 123*b* of the third straight portion 123 of the non-feed element 12 is open, whereby the antenna device 10 can easily cope with the frequency of the ultra-wide band by coupling the non-feed element 12 grounded to the ground plane 16 to the second portion 112 of the feed element 11.

According to the first embodiment, as hereinabove described, the length L2 of the second portion 112 in the linearly extensional direction (direction Y) of the feed element 11 is substantially equal to the length L4 of the two second straight portion 122 and third straight portion 123 of the non-feed element 12 in a direction (direction Y) along the extensional direction of the second portion 112 of the feed element 11, whereby the second portion 112 of the feed element 11 can be effectively coupled to the plurality of folded back portions (the first straight portion 121, the second straight portion 122, the third straight portion 123, the first coupling portion 124, and the second coupling portion 125) of the non-feed element 12. Thus, the antenna device 10 can easily cope with the frequency of the ultra-wide band.

According to the first embodiment, as hereinabove described, the upper end 122*a* of the second portion 112 of the feed element 11 is arranged at substantially the same height as the upper end 124*a* of the coupling portion 124 of the non-feed element 12 in the plan view, and the lower end 112*b* of the second portion 112 of the feed element 11 is arranged at substantially the same height as the lower end 125*a* of the coupling portion 125 of the non-feed element 12 in the plan view, whereby the second portion 112 of the feed element 11 can be more effectively coupled to the plurality of folded back portions (the first straight portion 121, the second straight portion 122, the third straight portion 123, the first coupling portion 124, and the second coupling portion 125) of the non-feed element 12. Furthermore, arrangement regions of the feed element 11 and the non-feed element 12 can be reduced in the height direction (direction Y) of the feed element 11 and the non-feed element 12, and hence the antenna device 10 can be effectively downsized.

According to the first embodiment, as hereinabove described, the two coupling portions 124 and 125 of the non-feed element 12 are formed to be folded back at the two positions along the extensional direction (direction Y) of the feed element 11, whereby the arrangement region of the non-feed element 12 can be reduced in the linearly extensional direction of the feed element 11, and hence the antenna device 10 can be further downsized.

According to the first embodiment, as hereinabove described, the feed element 11 and the non-feed element 12 are formed on the different layers, whereby the feed element 11 and the non-feed element 12 can be easily arranged to be opposed to each other in a wider region, and hence the feed element 11 and the non-feed element 12 can be effectively coupled to each other.

According to the first embodiment, as hereinabove described, the feed element 11 and the non-feed element 12 are arranged to overlap with each other in the plan view, whereby the plane areas of the arrangement regions of the feed element 11 and the non-feed element 12 can be reduced by the overlapping of the feed element 11 and the non-feed element 12 in the plan view, and hence the antenna device 10 can be easily downsized.

According to the first embodiment, as hereinabove described, the lower end 111*a* of the first portion 111 of the feed element 11 and the lower end 121*a* of the first straight portion 121 of the non-feed element 12 are arranged in the vicinity of the corner 151 of the ground plane 15 in a rectangular shape and in the vicinity of the corner 161 of the ground plane 16 in a rectangular shape, respectively, whereby sides forming the corners of the ground planes 15 and 16 in the rectangular shape to which the feed element 11 and the non-feed element 12 are grounded can function as antennas.

According to the first embodiment, as hereinabove described, the first portion 111 of the feed element 11 is coupled to the two coupling portions 124 and 125 of the non-feed element 12 along with the second portion 112 of the feed element 11, whereby the antenna device 10 coping with the ultrawide band can be more effectively configured by coupling both the second portion 112 and the first portion 111 of the feed element 11 to the plurality of folded back portions (the first straight portion 121, the second straight portion 122, the third straight portion 123, the first coupling portion 124, and the second coupling portion 125) of the non-feed element 12.

According to the first embodiment, as hereinabove described, the feeding point 14 supplying high-frequency power to the first portion 111 of the feed element 11 is arranged on the side of the first portion 111 of the feed element 11, whereby the second portion 112 of the feed element 11 can be easily coupled to the non-feed element 12 by supplying high-frequency power to the first portion 111 of the feed element 11.

According to the first embodiment, as hereinabove described, the non-feed element 12 is arranged to be folded back at a plurality of positions such that the folded back portions (the first straight portion 121, the second straight portion 122, and the third straight portion 123) extending along the extensional direction (direction Y) of the feed element 11 are separated from each other. Thus, in the non-feed element 12 including the first straight portion 121, the second straight portion 122, the third straight portion 123, the first coupling portion 124, and the second coupling portion 125, the first straight portion 121, the second straight portion 122, and the third straight portion 123 extending along the extensional direction of the feed element 11 can avoid interference with each other.

According to the first embodiment, as hereinabove described, the upper end 112*a* of the second portion 112 of the feed element 11 is arranged at substantially the same height as the upper end 124*a* of the coupling portion 124 of the non-feed element 12 in the plan view, and the lower end 112*b* of the second portion 112 of the feed element 11 is arranged at substantially the same height as the lower end 125*a* of the coupling portion 125 of the non-feed element 12 in the plan view, whereby the second portion 112 of the feed element 11 can be more effectively coupled to the plurality of folded back portions (the first straight portion 121, the second straight portion 122, the third straight portion 123, the first coupling portion 124, and the second coupling portion 125) of the non-feed element 12. Furthermore, arrangement regions of the feed element 11 and the non-feed element 12 can be reduced in the height direction (direction Y) of the feed element 11 and the non-feed element 12, and hence the antenna device 10 can be effectively downsized.

Results of a simulation conducted in order to confirm the aforementioned effects of the first embodiment are now described with reference to FIG. 5. In this simulation, the relationship (frequency characteristics) between a frequency and a VSWR (voltage standing wave ratio) in the cases where the lengths (L1+L2) in the direction Y of the feed element 11 and the non-feed element 12 of the antenna device 10 corresponding to the first embodiment shown in FIGS. 2 to 4 are varied to 10 mm, 12 mm, and 14 mm was obtained.

Figure 5:
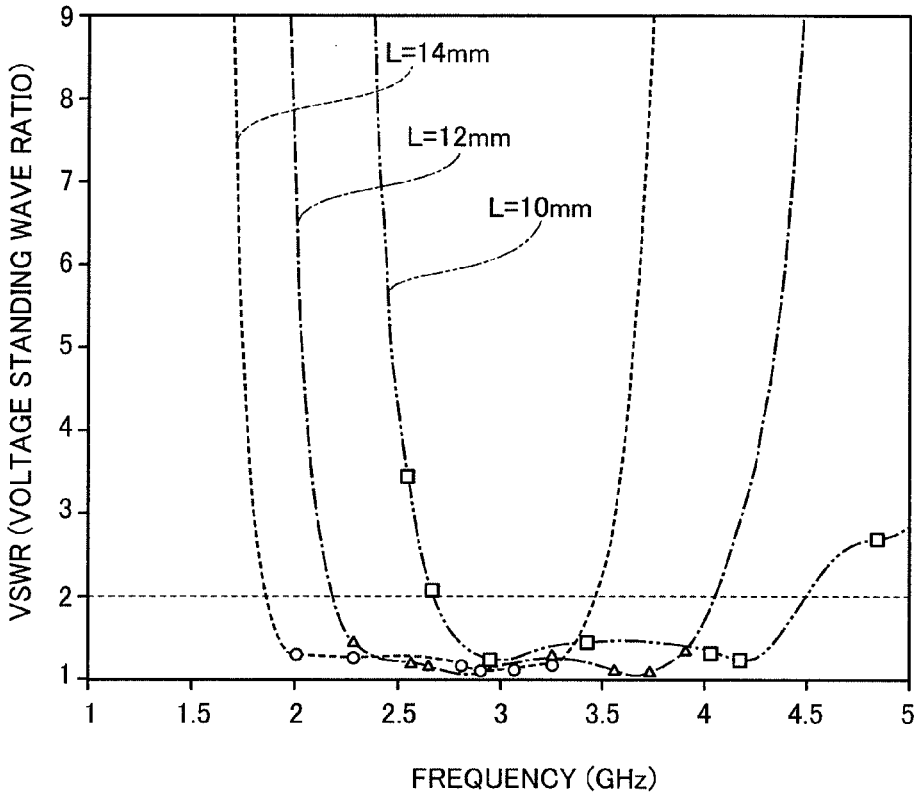
FIG. 5 A graph showing the relationship between a frequency and a VSWR in a simulation of the antenna device according to the first embodiment of the present invention.

In the results of the simulation shown in FIG. 5, the horizontal axis represents frequency (GHz), and the vertical axis represents VSWR (voltage standing wave ratio). In this simulation, a VSWR in the case where the magnitude of a frequency is varied in the range of at least 1 (GHz) and not more than 5 (GHz) is shown. When the VSWR is not more than 2, good antenna characteristics are conceivably obtained.

When the lengths (L1+L2) of the feed element 11 and the non-feed element 12 in the direction Y were 12 mm, the minimum frequency in the case where the VSWR was not more than 2 was about 2.2 (GHz). The maximum frequency in the case where the VSWR was not more than 2 was about 4.0 (GHz). In other words, it has been proved that the ratio of the maximum frequency (4.0 (GHz)) to the minimum frequency (2.2 (GHz)) in the case where the VSWR is not more than 2 is about 1.8.

When the lengths (L1+L2) of the feed element 11 and the non-feed element 12 in the direction Y were 10 mm, the minimum frequency in the case where the VSWR was not more than 2 was about 2.7 (GHz). The maximum frequency in the case where the VSWR was not more than 2 was about 4.5 (GHz). In other words, it has been proved that the ratio of the maximum frequency (4.5 (GHz)) to the minimum frequency (2.7 (GHz)) in the case where the VSWR is not more than 2 is about 1.7.

When the lengths (L1+L2) of the feed element 11 and the non-feed element 12 in the direction Y were 14 mm, the minimum frequency in the case where the VSWR was not more than 2 was about 1.9 (GHz). The maximum frequency in the case where the VSWR was not more than 2 was about 3.5 (GHz). In other words, it has been proved that the ratio of the maximum frequency (3.5 (GHz)) to the minimum frequency (1.9 (GHz)) in the case where the VSWR is not more than 2 is about 1.8.

From the aforementioned results, it has been confirmed that the ratio of the maximum frequency to the minimum frequency in the case where the VSWR is not more than 2 is at least about 1.7 and not more than about 1.8 when the lengths (L1+L2) of the feed element 11 and the non-feed element 12 in the direction Y are varied to 10 mm, 12 mm, and 14 mm. Thus, it has been confirmed that the antenna device 10 corresponding to the first embodiment has ultra-wideband characteristics in which the ratio of the maximum frequency of the utilized frequency band to the minimum frequency of the utilized frequency band is at least about 1.5. From the aforementioned results of the simulation, it has been confirmed that the utilized frequency band can be adjusted by varying (adjusting) the lengths (L1+L2) of the feed element 11 and the non-feed element 12 while the wideband characteristics are maintained.

This is conceivably for the following reason. In other words, the antenna device 10 corresponding to the first embodiment can conceivably cope with the frequency of the ultrawide band by coupling the feed element 11 to the non-feed element 12.

Second Embodiment

Figure 6:
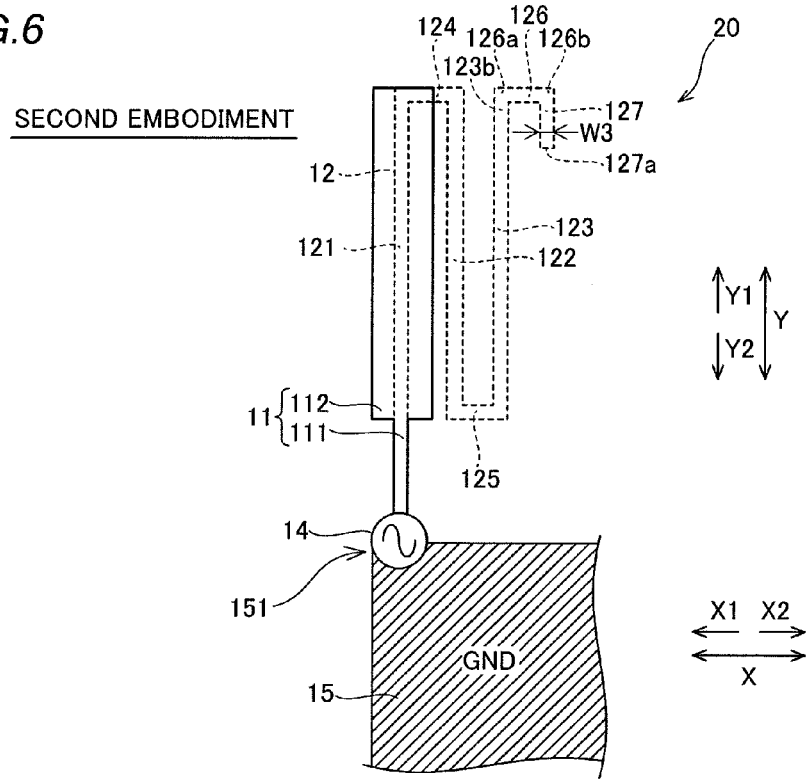
FIG. 6 A diagram showing an antenna device of a portable telephone according to a second embodiment of the present invention.

An antenna device 20 according to a second embodiment of the present invention is now described with reference to FIG. 6. In this second embodiment, the antenna device 20 including a third coupling portion 126 coupled to a third straight portion 123 and a fourth straight portion 127 coupled to the third coupling portion 126 is described, unlike in the aforementioned first embodiment. The third coupling portion 126 and the fourth straight portion 127 are examples of the "folded back portion" in the present invention.

The antenna device 20 according to the second embodiment includes the third coupling portion 126 coupled to the third straight portion 123 and the fourth straight portion 127 coupled to the third coupling portion 126. The third coupling portion 126 is formed to extend in a direction X. The fourth straight portion 127 is formed to extend in a direction Y. A left end 126*a* of the third coupling portion 126 on an X1 side is coupled to an upper end 123*b* of the third straight portion 123. The fourth straight portion is 127 is coupled to a right end 126*b* of the third coupling portion 126 on an X2 side. A lower end 127*a* of the fourth straight portion 127 is open.

The third coupling portion 126 is arranged substantially parallel to a first coupling portion 124 and a second coupling portion 125 and is arranged at substantially the same height as the first coupling portion 124.

The fourth straight portion 127 is arranged substantially parallel to a first straight portion 121, a second straight portion 122, and the third straight portion 123. The length of the fourth straight portion 127 in the direction Y is shorter than the length of each of the first straight portion 121, the second straight portion 122, and the third straight portion 123 and has a length not more than about one-quarter of the length of each of the second straight portion 122 and the third straight portion 123. The third coupling portion 126 and the fourth straight portion 127 each have a width W3 of about 0.4 mm.

The remaining structure and the effects of the antenna device 20 according to the second embodiment are similar to those of the antenna device 10 according to the aforementioned first embodiment.

Results of a simulation conducted in order to confirm the aforementioned effects of the second embodiment are now described with reference to FIG. 7. In this simulation, the relationship (frequency characteristics) between a frequency and a VSWR (voltage standing wave ratio) and the relationship between a frequency and S11 (dB) in the case where the lengths (L1+L2) in the direction Y of a feed element 11 and a non-feed element 12 of the antenna device 20 corresponding to the second embodiment shown in FIG. 6 are 12 mm are described. The S11 (dB) denotes the reflection coefficient of the feed element 11.

Figure 7:
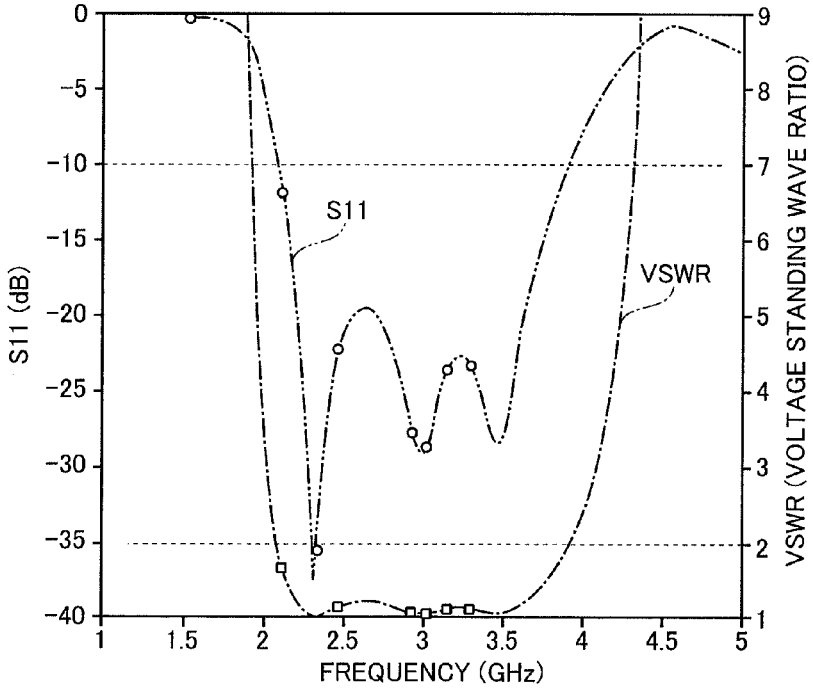
FIG. 7 A graph showing the relationship between a frequency and a S11 parameter and the relationship between a frequency and a VSWR in a simulation of the antenna device according to the second embodiment of the present invention.

In the results of the simulation shown in FIG. 7, the horizontal axis represents frequency (GHz), the vertical axis (the left vertical axis in FIG. 7) represents S11 (dB), and the vertical axis (the right vertical axis in FIG. 7) represents VSWR (voltage standing wave ratio). In this simulation, a VSWR and S11 (dB) in the case where a frequency is varied in the range of at least 1 (GHz) and not more than 5 (GHz) are shown. When the VSWR is not more than 2, good antenna characteristics are conceivably obtained. Furthermore, when the S11 is not more than −10 (dB), good antenna characteristics are conceivably obtained.

In the antenna device 20 corresponding to the second embodiment, the minimum frequency in the case where the VSWR was not more than 2 was about 2.1 (GHz). The maximum frequency in the case where the VSWR was not more than 2 was about 4.0 (GHz). In other words, it has been proved that the ratio of the maximum frequency (4.0 (GHz)) to the minimum frequency (2.1 (GHz)) in the case where the VSWR is not more than 2 is about 1.9.

The minimum frequency in the case where the S11 was not more than −10 (dB) was about 2.1 (GHz). The maximum frequency in the case where the S11 was not more than −10 (dB) was about 3.9 (GHz). In other words, it has been proved that the ratio of the maximum frequency (3.9 (GHz)) to the minimum frequency (2.1 (GHz)) in the case where the S11 is not more than −10 (dB) is about 1.9.

From the aforementioned results, it has been confirmed that in the antenna device 20 corresponding to the second embodiment, the ratio of the maximum frequency to the minimum frequency in each of the cases where the VSWR is not more than 2 and the S11 is not more than −10 (dB) is about 1.9. Thus, it has been confirmed that the antenna device 20 corresponding to the second embodiment has ultra-wideband characteristics in which the ratio of the maximum frequency of the utilized frequency band to the minimum frequency of the utilized frequency band is at least about 1.5.

Figure 8:
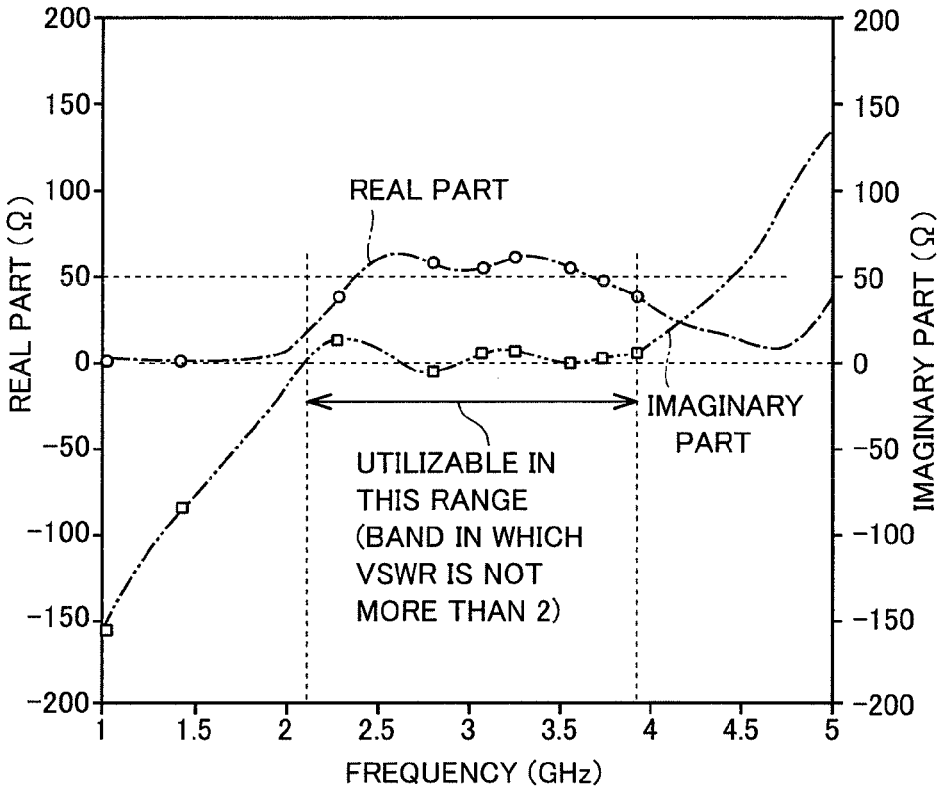
FIG. 8 A graph showing the relationship between a frequency and a value of a real part of an impedance and the relationship between a frequency and a value of an imaginary part of an impedance in a simulation of the antenna device according to the second embodiment of the present invention.

The relationship between the frequency and the input impedance Z (the real part (resistance) and the imaginary part (reactance)) of the antenna device 20 corresponding to the second embodiment is now described with reference to FIG. 8. In FIG. 8, the horizontal axis represents frequency (GHz), the left vertical axis represents real part (Ω) (resistance) of input impedance Z, and the right vertical axis represents imaginary part (Ω) (reactance) of input impedance Z.

As results of a simulation shown in FIG. 8, it has been confirmed that in the antenna device 20 corresponding to the second embodiment, the real part (resistance) of the input impedance Z of the feed element 11 is about 50 (Ω), and the imaginary part (reactance) of the input impedance Z of the feed element 11 is about 0 (Ω) in a range in which the minimum frequency is at least about 2.1 (GHz) and the maximum frequency is not more than about 4.0 (GHz), that is a favorable range for using the antenna device 20. In other words, it has been confirmed that the antenna device 20 corresponding to the second embodiment has ultra-wideband characteristics in which the ratio of the utilized maximum frequency to the utilized minimum frequency is at least about 1.5 in a frequency band in which the real part (resistance) of the input impedance Z is about 50 (Ω) and the imaginary part (reactance) of the input impedance Z is about 0 (Ω).

Third Embodiment

Figure 9:
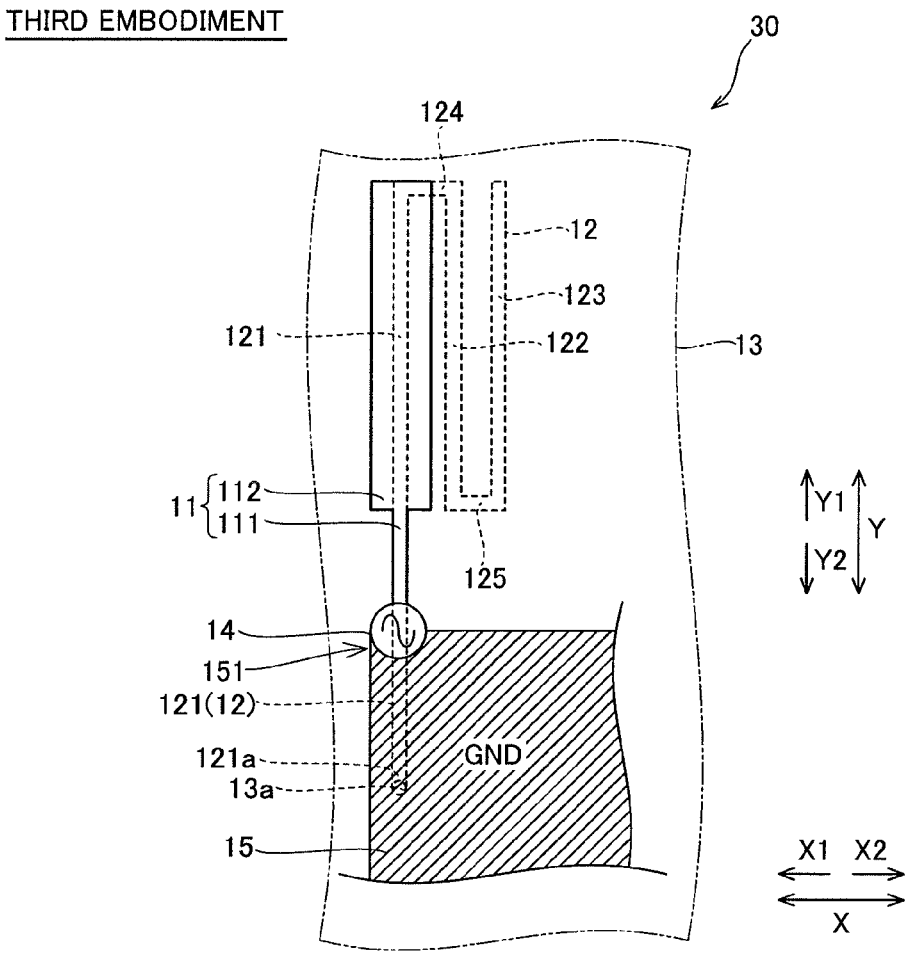
FIG. 9 A diagram showing an antenna device of a portable telephone according to a third embodiment of the present invention.

An antenna device 30 according to a third embodiment of the present invention is now described with reference to FIG. 9. In this third embodiment, an example of grounding a non-feed element 12 to a first ground plane 15 through an opening 13*a* formed in a substrate 13 is described, unlike in the aforementioned first embodiment.

In the antenna device 30 according to the third embodiment, a lower end 121*a* of a first straight portion 121 of the non-feed element 12 is arranged to overlap with the first ground plane 15 arranged on the front surface of the substrate 13 in a plan view. No ground plane is provided on the rear surface of the substrate 13. The length of the first straight portion 121 of the non-feed element 12 in a direction Y is larger than the length of a feed element 11 in the direction Y. The substrate 13 is formed with the opening 13*a* (through-hole). The lower end 121*a* of the first straight portion 121 of the non-feed element 12 is grounded (connected) to the first ground plane 15 arranged on the front surface of the substrate 13 through the opening 13*a*. In the plan view, a portion of the first straight portion 121 overlapping with the first ground plane 15 preferably has an electrical length smaller than λ/40.

The remaining structure and the effects of the antenna device 30 according to the third embodiment are similar to those of the antenna device 10 according to the aforementioned first embodiment.

Fourth Embodiment

Figure 10:
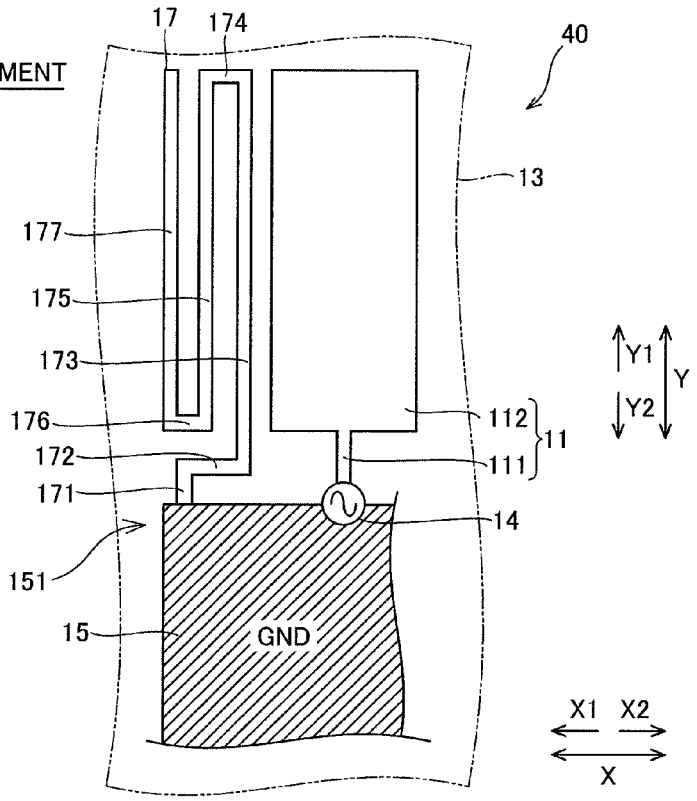
FIG. 10 A diagram showing an antenna device of a portable telephone according to a fourth embodiment of the present invention.

An antenna device 40 according to a fourth embodiment of the present invention is now described with reference to FIG. 10. In this fourth embodiment, an example of arranging a feed element 11 and a non-feed element 17 on the same layer (on the frons surface of the same substrate 13) is described, unlike in the aforementioned first embodiment.

In the antenna device 40 according to the fourth embodiment, the feed element 11 and the non-feed element 17 are arranged at a prescribed interval in a direction X on the same layer (on the front surface of the same substrate 13). The non-feed element 17 is arranged in the vicinity of a corner 151 of a first ground plane 15, and the feed element 11 is arranged on the X2 side (a side opposite to the corner 151) of the non-feed element 17. The length of the feed element 11 in a direction Y is substantially equal to the length of the non-feed element 17 in the direction Y.

The non-feed element 17 includes a first straight portion 171, a second straight portion 172, a third straight portion 173, a first coupling portion 174, a fourth straight portion 175, a second coupling portion 176, and a fifth straight portion 177 that are connected to the first ground plane 15. The first straight portion 171, the third straight portion 173, the fourth straight portion 175, and the fifth straight portion 177 extend in the direction Y and are arranged substantially parallel to each other. The second straight portion 172, the first coupling portion 174, and the second coupling portion 176 extend in the direction X and are arranged substantially parallel to each other. The first straight portion 171, the second straight portion 172, the third straight portion 173, the first coupling portion 174, the fourth straight portion 175, the second coupling portion 176, and the fifth straight portion 177 are examples of the "folded back portion" in the present invention.

The entire non-feed element 17 (the first straight portion 171, the second straight portion 172, the third straight portion 173, the first coupling portion 174, the fourth straight portion 175, the second coupling portion 176, and the fifth straight portion 177) is configured to be coupled to the entire feed element 11 (a first portion 111 and a second portion 112). The third straight portion 173 of the non-feed element 17 is arranged in the vicinity of the feed element 11 and is configured to be relatively strongly coupled to the feed element 11.

The length of the third straight portion 173 in the direction Y is longer than the length of the second portion 112 of the feed element 11 in the direction Y and is shorter than the length of the entire feed element 11 (the first portion 111 and the second portion 112) in the direction Y. The lengths of the fourth straight portion 175 and the fifth straight portion 177 in the direction Y are substantially equal to the length of the entire feed element 11 (the first portion 111 and the second portion 112) in the direction Y. The non-feed element 17 has a substantially uniform width over an entire portion thereof.

The remaining structure of the antenna device 40 according to the fourth embodiment is similar to that of the antenna device 10 according to the aforementioned first embodiment.

According to the fourth embodiment, as hereinabove described, the feed element 11 and the non-feed element 12 are formed on the same layer (on the front surface of the same substrate 13), whereby the thickness of the entire device can be reduced, and hence the antenna device 40 can be easily downsized.

According to the fourth embodiment, as hereinabove described, the feed element 11 and the non-feed element 12 are arranged to be separated by a distance allowing the feed element 11 and the non-feed element 12 to be coupled to each other, whereby the feed element 11 and the non-feed element 12 are easily coupled to each other, and hence the antenna device 40 can cope with the frequency of an ultrawide band.

The remaining effects of the fourth embodiment are similar to those of the aforementioned first embodiment.

Results of a simulation conducted in order to confirm the aforementioned effects of the fourth embodiment are now described with reference to FIG. 11. In this simulation, the relationship (frequency characteristics) between a frequency and a VSWR (voltage standing wave ratio) of the antenna device 40 corresponding to the fourth embodiment shown in FIG. 10 is described.

Figure 11:
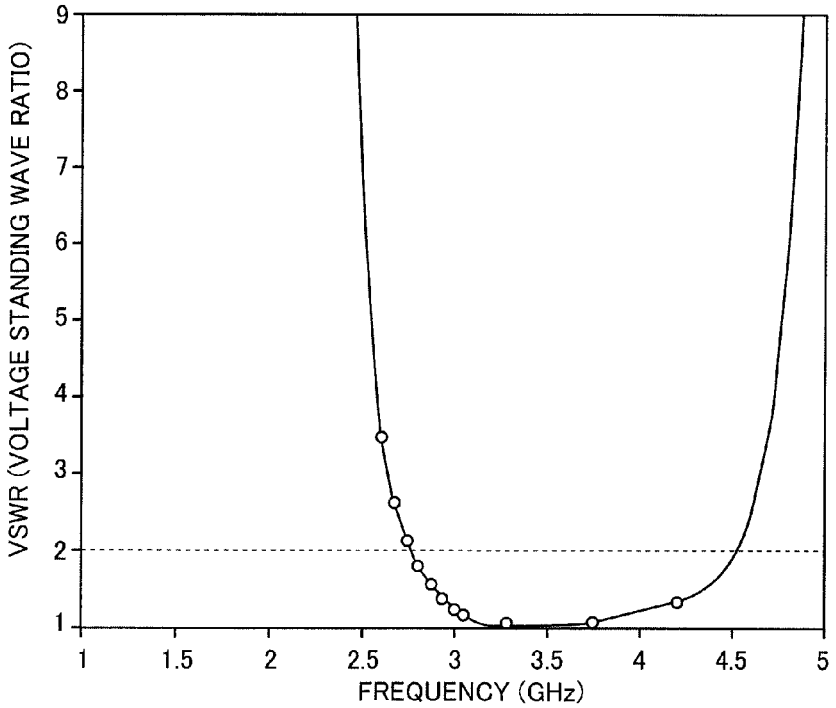
FIG. 11 A graph showing the relationship between a frequency and a VSWR in a simulation of the antenna device according to the fourth embodiment of the present invention.

In the results of the simulation shown in FIG. 11, the horizontal axis represents frequency (GHz), and the vertical axis represents VSWR (voltage standing wave ratio). In this simulation, a VSWR in the case where a frequency is varied in the range of at least 1 (GHz) and not more than 5 (GHz) is shown. When the VSWR is not more than 2, good antenna characteristics are conceivably obtained.

In the antenna device 40 corresponding to the fourth embodiment, the minimum frequency in the case where the VSWR was not more than 2 was about 2.7 (GHz). The maximum frequency in the case where the VSWR was not more than 2 was about 4.5 (GHz). In other words, it has been proved that the ratio of the maximum frequency (4.5 (GHz)) to the minimum frequency (2.7 (GHz)) in the case where the VSWR is not more than 2 is about 1.6. The wideband characteristics (about 1.6) of the antenna device 40 corresponding to the fourth embodiment are slightly inferior as compared with the ratio (at least about 1.7 and not more than about 1.9) of the maximum frequency to the minimum frequency of each of the antenna devices 10 and 20 according to the aforementioned first and second embodiments, but the antenna device 40 can cover all of a plurality of frequency bands (a 2.3 GHz band, a 2.6 GHz band, and a 3.5 GHz band) utilized in WiMAX of a high-speed wireless communication network. Thus, it has been confirmed that a plurality of antenna devices are not required.

The embodiments disclosed this time must be considered as illustrative in all points and not restrictive. The range of the present invention is shown not by the above description of the embodiments but by the scope of claims for patent, and all modifications within the meaning and range equivalent to the scope of claims for patent are further included.

For example, while the portable telephone has been shown as the example of the communication equipment including the antenna device in each of the aforementioned first to fourth embodiments, the present invention is not restricted to this. The present invention is also applicable to a communication equipment other than the portable telephone such as a PDA (personal digital assistant) or a small notebook computer including the antenna device, for example. Furthermore, the present invention is also applicable to an equipment other than the communication equipment, so far as the same includes the antenna device.

While the example of configuring the antenna device to cope with the WiMAX of the 2.3 GHz band, the 2.6 GHz band, and the 3.5 GHz band has been shown in each of the aforementioned first to fourth embodiments, the present invention is not restricted to this. According to the present invention, the antenna device may be configured to cope with frequencies other than the 2.3 GHz band, the 2.6 GHz band, and the 3.5 GHz band, for example or may be configured to cope with a format other than the WiMAX such as GSM (registered trademark) or 3G.

Figure 12:
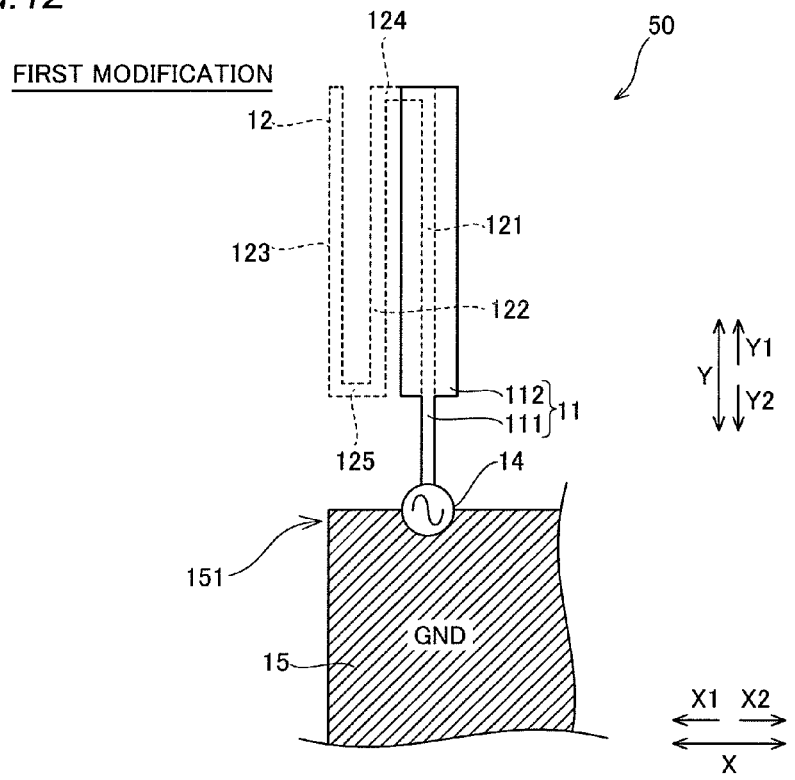
FIG. 12 A diagram of an antenna device showing a first modification of the first to third embodiments of the present invention.

While the example of arranging the first straight portion 121 of the non-feed element 12 on the X1 side and arranging the third straight portion 123 of the non-feed element 12 on the X2 side has been shown in each of the aforementioned first to third embodiments, the present invention is not restricted to this. According to the present invention, the first straight portion 121 of the non-feed element 12 may be arranged on the X2 side, and the third straight portion 123 of the non-feed element 12 may be arranged on the X1 side, as in an antenna device 50 according to a first modification shown in FIG. 12, for example.

Figure 13:
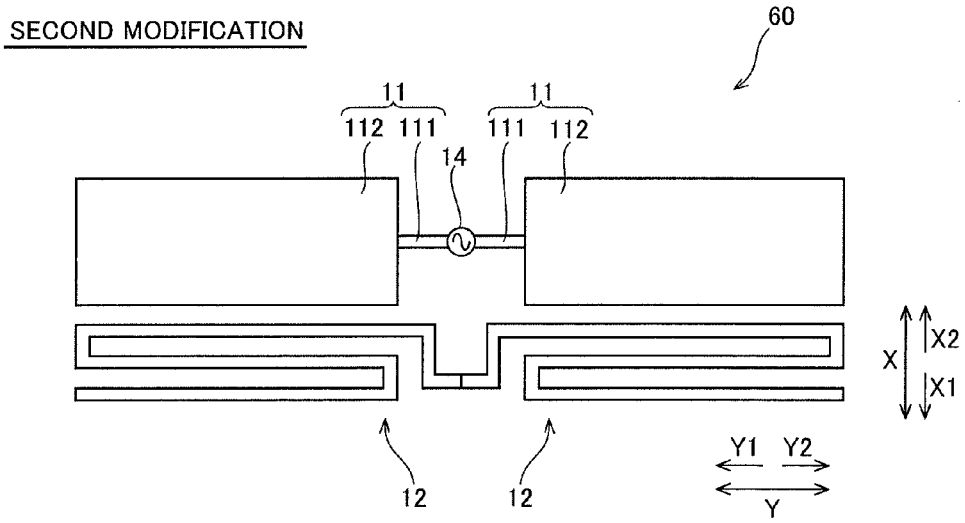
FIG. 13 A diagram of an antenna device of a dipole antenna showing a second modification of the first to fourth embodiments of the present invention.

While the feed element of a monopole antenna has been shown as the example of the antenna device in each of the aforementioned first to fourth embodiments, the present invention is not restricted to this. According to the present invention, a feed element other than the monopole antenna such as a dipole antenna may be employed. In the case of a feed element 11 of the dipole antenna as in an antenna device 60 according to a second modification shown in FIG. 13, for example, the feed element 11 may be provided in each of regions on a Y1 side and a Y2 side with respect to a feeding point 14. Furthermore, a non-feed element 12 may be provided in a region on the X1 side of each of the feed elements 11.

Figure 14:
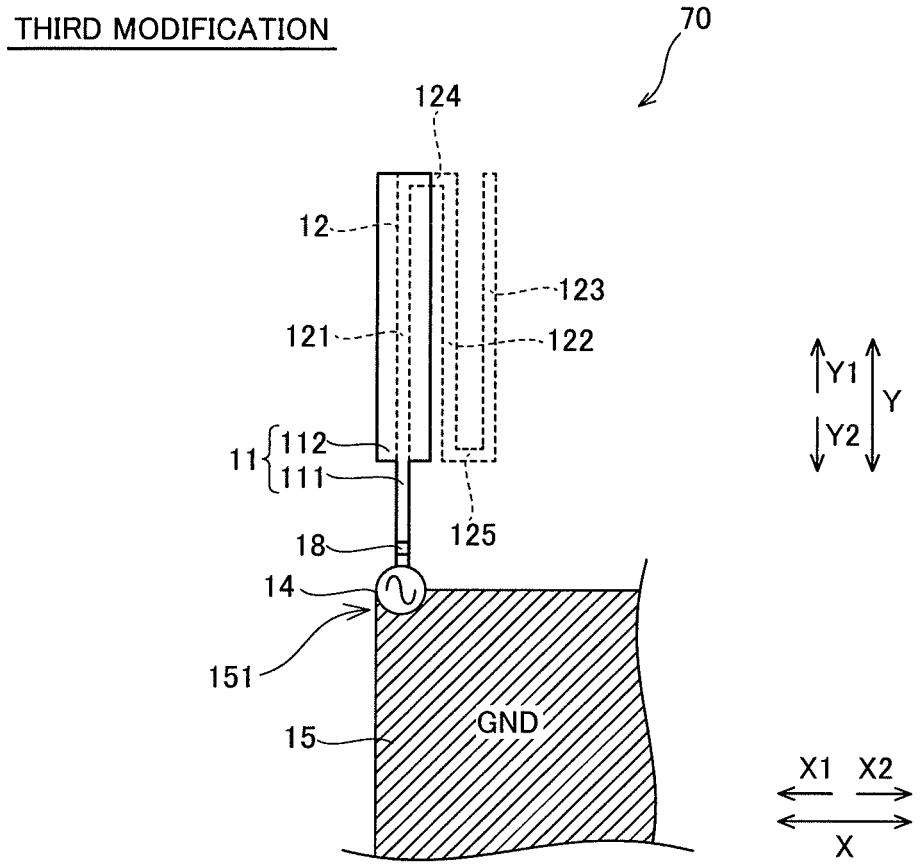
FIG. 14 A diagram of an antenna device provided with a matching circuit showing a third modification of the first to fourth embodiments of the present invention.
Figure 15:
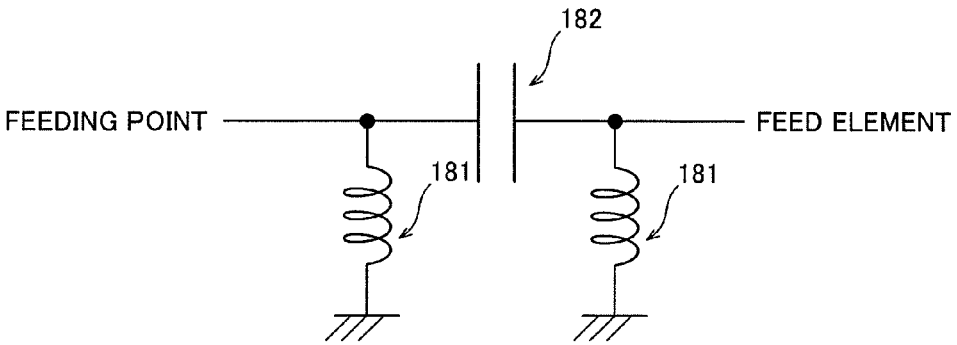
FIG. 15 A diagram showing a π-type matching circuit of the antenna device according to the third modification shown in FIG. 14.
Figure 16:
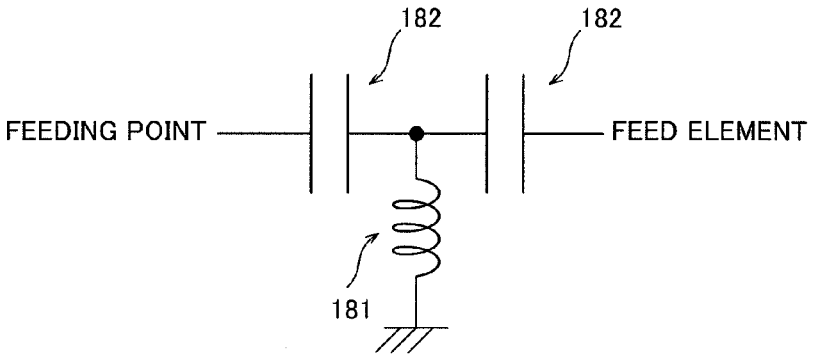
FIG. 16 A diagram showing a T-type matching circuit of the antenna device according to the third modification shown in FIG. 14.
Figure 17:
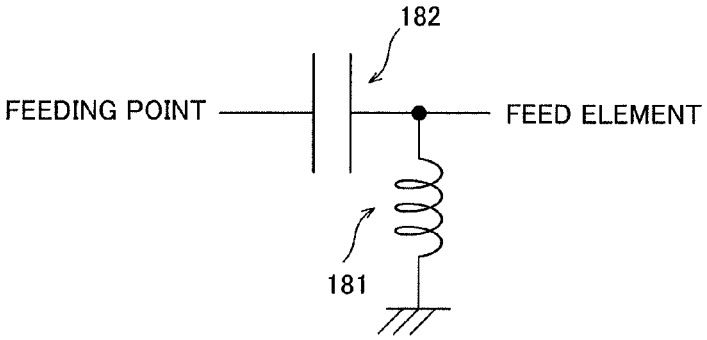
FIG. 17 A diagram showing an L-type matching circuit of the antenna device according to the third modification shown in FIG. 14.

While the structure of providing no matching circuit configured to match impedance between the feeding point and the feed element has been shown in each of the aforementioned first to fourth embodiments, the present invention is not restricted to this. According to the present invention, a matching circuit configured to match impedance in a prescribed frequency of high-frequency power may be provided between the feeding point and the feed element. As in an antenna device 70 according to a third modification shown in FIG. 14, for example, a matching circuit 18 may be provided between a feeding point 14 and a feed element 11 of the antenna device 70. Thus, in a prescribed frequency, impedance is matched, and hence a transfer loss of energy transferred through the feed element 11 can be further reduced. The matching circuit 18 may include a π-type circuit (π match) constituted by inductors 181 (coils) and a capacitor 182 (condenser) shown in FIG. 15, a T-type circuit (T match) constituted by an inductor 181 and capacitors 182 shown in FIG. 16, an L-type circuit (L match) constituted by an inductor 181 and a capacitor 182 shown in FIG. 17, or the like, for example. Furthermore, the π-type circuit, the T-type circuit, the L-type circuit, or the like may be constituted by only one of the inductor(s) 181 and the capacitor(s) 182 or may be constituted by both the inductor(s) 181 and the capacitor(s) 182.

While the example of rendering the length of the third straight portion 123 of the non-feed element 12 in the direction Y substantially equal to the lengths of the first straight portion 121 and the second straight portion 122 in the direction Y has been shown in the aforementioned first embodiment, the present invention is not restricted to this. According to the present invention, the length of the third straight portion 123 of the non-feed element 12 in the direction Y may be rendered shorter than the lengths of the first straight portion 121 and the second straight portion 122 in the direction Y, for example. Also according to this, the antenna device having the ultra-wideband characteristics in which the ratio of the maximum frequency to the minimum frequency in the case where the VSWR is not more than 2 is at least about 1.7 and not more than about 1.8 as in the results of the simulation shown in FIG. 5 can be configured.

While the example of rendering the length of the fourth straight portion 127 of the non-feed element 12 in the direction Y shorter than the lengths of the first straight portion 121, the second straight portion 122, and the third straight portion 123 in the direction Y has been shown in the aforementioned second embodiment, the present invention is not restricted to this. The length of the fourth straight portion 127 of the non-feed element 12 in the direction Y may be rendered substantially equal to the lengths of the second straight portion 122 and the third straight portion 123 in the direction Y, for example. Also according to this, the antenna device having the ultra-wideband characteristics in which the ratio of the maximum frequency to the minimum frequency in the case where the VSWR is not more than 2 is about 1.9 as in the results of the simulation shown in FIG. 7 can be configured.

While the example in which the number of times that the non-feed element is folded back is twice has been shown in each of the aforementioned first, third, and fourth embodiments and the example in which the number of times that the non-feed element is folded back is three times has been shown in the aforementioned second embodiment, the present invention is not restricted to this. According to the present invention, the number of times that the non-feed element is folded back may be four times or more. However, the number of times that the non-feed element is folded back is preferably twice or three times.

REFERENCE NUMERALS

10, 20, 30, 40, 50, 60, 70: antenna device
11: feed element
12: non-feed element
14: feeding point
15, 16: ground plane
100: portable telephone (communication equipment)
111: first portion
112: second portion
121, 171: first straight portion (folded back portion)
122, 172: second straight portion (folded back portion)
123, 173: third straight portion (folded back portion)
122, 172: second straight portion (folded back portion)
124, 174: first coupling portion (folded back portion)
125, 176: second coupling portion (folded back portion)
126: third coupling portion (folded back portion)
127, 175: fourth straight portion (folded back portion)
151, 161: corner
177: fifth straight portion (folded back portion)

The invention claimed is:

1. An antenna device comprising:

a feed element including a first portion and a second portion having a width larger than a width of the first portion; and a non-feed element including a plurality of folded back portions folded back at a plurality of positions, wherein the width (W2) of the second portion of the feed element is rendered larger than a width (W3) of the non-feed element in directions orthogonal to extensional directions of the plurality of folded back portions, at least the second portion of the feed element is configured to be coupled to the plurality of folded back portions of the non-feed element, and a first end of the second portion in a predetermined direction in which the first portion and the second portion are aligned and a first end of the folded back portions in the predetermined direction are arranged to be opposed to each other, and a second end of the second portion in the predetermined direction and a second end of the folded back portions in the redetermined direction are arranged to be opposed to each other.

2. The antenna device according to claim 1, further comprising a ground plane configured to ground the non-feed element, wherein a first end of the non-feed element is grounded to the ground plane, and a second end of the non-feed element is open.

3. The antenna device according to claim 1, wherein the feed element is formed to extend linearly, and a length (L2) of the second portion along an extensional direction of the feed element is substantially equal to lengths (L4) of the plurality of folded back portions of the non-feed element along the extensional direction of the feed element.

4. The antenna device according to claim 1, wherein the feed element is formed to extend linearly, and the plurality of folded back portions of the non-feed element are formed to be folded back at the plurality of positions along an extensional direction of the feed element.

5. The antenna device according to claim 1, further comprising a ground plane configured to ground the non-feed element, wherein the ground plane has a corner formed by two sides substantially orthogonal to each other, and the first portion of the feed element and a first end of the non-feed element are arranged in a vicinity of the corner of the ground plane.

6. The antenna device according to claim 5, wherein the ground plane is formed in a rectangular shape having the corner formed by the two sides substantially orthogonal to each other, and the first portion of the feed element and the first end of the non-feed element are arranged in the vicinity of the corner of the ground plane having the rectangular shape.

7. The antenna device according to claim 1, wherein the first portion of the feed element is configured to be coupled to the plurality of folded back portions of the non-feed element along with the second portion of the feed element.

8. The antenna device according to claim 1, further comprising a feeding point arranged on a side of the first portion of the feed element, supplying high-frequency power to the first portion of the feed element.

9. The antenna device according to claim 1, wherein the feed element is formed to extend linearly, and the non-feed element is arranged to be folded back such that the folded back portions extending along an extensional direction of the feed element are separated from each other.

10. The antenna device according to claim 1, wherein the feed element is formed to extend linearly, and a length (L1) of the first portion along an extensional direction of the feed element is not more than one-half of a length (L2) of the second portion along the extensional direction of the feed element.

11. A communication equipment comprising:

an antenna device, the antenna device including:

a feed element including a first portion and a second portion having a width larger than a width of the first portion, and a non-feed element including a plurality of folded back portions folded back at a plurality of positions, wherein the width (W2) of the second portion of the feed element is rendered larger than a width (W3) of the non-feed element in directions orthogonal to extensional directions of the plurality of folded back portions, at least the second portion of the feed element is configured to be coupled to the plurality of folded back portions of the non-feed element, and a first end of the second portion in a predetermined direction in which the first portion and the second portion are aligned and a first end of the folded back portions in the predetermined direction are arranged to be opposed to each other, and a second end of the second portion in the predetermined direction and a second end of the folded back portions in the predetermined direction are arranged to be opposed to each other.

12. The communication equipment according to claim 11, wherein the antenna device further includes a ground plane configured to ground the non-feed element, and a first end of the non-feed element is grounded to the ground plane, and a second end of the non-feed element is open.

13. The communication equipment according to claim 11, wherein the feed element is formed to extend linearly, and a length (L2) of the second portion along an extensional direction of the feed element is substantially equal to lengths (L4) of the plurality of folded back portions of the non-feed element along the extensional direction of the feed element.

14. The communication equipment according to claim 13, wherein an upper end of the second portion of the feed element is arranged at substantially a same height as an upper end of the folded back portions of the non-feed element in a plan view, and a lower end of the second portion of the feed element is arranged at substantially a same height as a lower end of the folded back portions of the non-feed element in the plan view.

15. The communication equipment according to claim 11, wherein the feed element is formed to extend linearly, and the plurality of folded back portions of the non-feed element are formed to be folded back at the plurality of positions along an extensional direction of the feed element.

* * * * *